US006931348B2

(12) United States Patent
Furuta et al.

(10) Patent No.: US 6,931,348 B2
(45) Date of Patent: Aug. 16, 2005

(54) DATA PROCESSING APPARATUS FOR DIVERS AND A DATA PROCESSING METHOD, PROGRAM, AND RECORDING PROGRAM STORING THE SAME

(75) Inventors: Naoshi Furuta, Shiojiri (JP); Masao Kuroda, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 132 days.

(21) Appl. No.: 10/382,279

(22) Filed: Mar. 5, 2003

(65) Prior Publication Data

US 2003/0220762 A1 Nov. 27, 2003

(30) Foreign Application Priority Data

Mar. 8, 2002 (JP) ..... 2002-063758

(51) Int. Cl.[7] ..... G01L 11/00
(52) U.S. Cl. ..... 702/138; 128/201.27
(58) Field of Search ..... 702/138

(56) References Cited

U.S. PATENT DOCUMENTS 5,049,864 A 9/1991 Barshinger
5,499,179 A * 3/1996 Sato ..... 128/201.27

FOREIGN PATENT DOCUMENTS

| | | |
|---|---|---|
| EP | 0 805 105 | 11/1997 |
| JP | 2-179594 | 7/1990 |
| JP | 5-141973 | 6/1993 |
| JP | 5-167561 | 7/1993 |
| JP | 7-17479 | 1/1995 |
| JP | 2003-187011 | 7/2003 |

OTHER PUBLICATIONS

"Dive Computers, A Consumer's Guide to History, Theory, and Performance"; Ken Loyst, et al., Watersport Publishing Inc. (1991).
"Decompression–Decompression Sickness"; A.A. Buhlmann, Springer, Berlin (1984).

* cited by examiner

*Primary Examiner*—John Barlow
*Assistant Examiner*—Xiuqin Sun
(74) *Attorney, Agent, or Firm*—Rosalio Haro

(57) ABSTRACT

Unnecessary operations are eliminated in the calculation of a non-decompression limit at the current water dept. In this manner, the calculation of the non-decompression limit is made more efficient and the required computing time is shorten to the point where the function can be incorporated into a wrist worn device that provides timely data.

30 Claims, 8 Drawing Sheets

Table 1

53a

| TISSUE COMPARTMENT COMPn | 1 | 2 | 3 | 4 | 5 | 6 | 7 | 8 |
|---|---|---|---|---|---|---|---|---|
| SATURATION HALF-TIME Th OF NITROGEN (minutes) | 4 | 8 | 12.5 | 18.5 | 27 | 38.3 | 54.3 | 77 |
| SATURATION HALF-TIME Th OF HELIUM (minutes) | 1.5 | 3 | 4.7 | 7 | 10.2 | 14.5 | 20.5 | 29.1 |
| MAXIMUM TOLERATED NITROGEN PARTIAL PRESSURE M0 (msw) | 32.4 | 25.354 | 22.462 | 20.338 | 18.954 | 17.785 | 16.769 | 15.938 |
| TISSUE COMPARTMENT COMPn | 9 | 10 | 11 | 12 | 13 | 14 | 15 | 16 |
| SATURATION HALF-TIME Th OF NITROGEN (minutes) | 109 | 146 | 187 | 239 | 305 | 390 | 498 | 635 |
| SATURATION HALF-TIME Th OF HELIUM (minutes) | 41.2 | 55.2 | 70.7 | 90.3 | 115.3 | 147.4 | 188 | 240 |
| MAXIMUM TOLERATED NITROGEN PARTIAL PRESSURE M0 (msw) | 15.2 | 14.646 | 14.215 | 13.846 | 13.508 | 13.2 | 12.923 | 12.677 |

FIG. 3

| TISSUE COMPARTMENT COMPn | NO-DECOMPRESSION LIMIT NDLn |
|---|---|
| 1 | 40 |
| 2 | 40 |
| 3 | 40 |
| 4 | 38 |
| 5 | 38 |
| 6 | 38 |
| 7 | 38 |
| 8 | 38 |
| 9 | 38 |
| 10 | 38 |
| 11 | 38 |
| 12 | 38 |
| 13 | 38 |
| 14 | 38 |
| 15 | 38 |
| 16 | 38 |

FIG. 6

FIRST EMBODIMENT

SECOND EMBODIMENT

DATA PROCESSING APPARATUS FOR DIVERS AND A DATA PROCESSING METHOD, PROGRAM, AND RECORDING PROGRAM STORING THE SAME

BACKGROUND OF THE INVENTION

1. Field of the Invention

The present invention relates to a data processing apparatus for divers for efficiently calculating the non-decompression limit, a data processing method for the same, a program for executing this method, and a recording medium for storing the program.

2. Description of the Related Art

A data processing apparatus for divers, more commonly referred to as a dive computer, has various safety functions that help to assure safe diving. One of these functions calculates the non-decompression limit, that is, the limit specifying how long a diver can dive safely without risk of decompression sickness, based on the accumulation of inert gases (particularly nitrogen) in the tissues of the diver's body. Various theories are used to compute this accumulation of inert gases in the tissues, and divers preferably dive within the non-decompression limit determined by the dive computer.

Dive computers are discussed in detail in "Dive Computers, A Consumer's Guide to History, Theory, and Performance," by Ken Loyst, et al., Watersport Publishing Inc. (1991). Diving theory is also discussed in detail in "Decompression-Decompression Sickness," by A. A. Buhlmann, Springer, Berlin (1984). These books note the following.

1. Different body tissues absorb (in-gas) and release (out-gas) inert gases at different rates and are grouped into "tissue compartments", or tissue types, according to the rate of inert gas absorption and release.

2. Body tissues absorb and release inert gases at an exponential rate.

3. The saturation half-time, which is the time required for a body tissue to become half saturated, is used to express the rate of inert gas absorption and release.

4. Each tissue compartment has a particular saturation half-time and maximum inert gas partial pressure at which a safe ascent to the surface is possible, and this is referred to as the maximum tolerated (inert gas) partial pressure (the M value, M0).

5. The risk of decompression sickness occurs when a diver ascends with inert gas exceeding this maximum tolerated partial pressure (M value) still dissolved in the body tissues.

6. In general recreational diving, nitrogen is the most common inert gas.

These findings are based on experience and experimental diving, and have not been fully explained physiologically. Further, these findings were not obtained by monitoring divers while diving, and are based on mathematically modeled simulations. It is clear that more accurate simulations are important not only for preventing decompression sickness but also for improving diving safety.

The non-decompression limit is the shortest time required for a particular tissue compartment to reach the maximum tolerated inert gas partial pressure. The non-decompression limit at a given depth is calculated using an exponential function or logarithmic function based on the measured depth (or water pressure).

During a single dive of approximately one hour the dive computer measures the water depth every second and calculates the non-decompression limit from the measured water depth. This requires a massive number of calculations and high battery power consumption. Dive computers are therefore unable to use the common button batteries used in wristwatches because of the danger that the battery will wear out during the dive.

Portable dive computers therefore typically use a relatively slow 4-bit or 8-bit CPU in an effort to extend battery life, but such CPUs do not have the ability to process these functions. Constants are therefore derived for the exponential functions used in the non-decompression limit equations to simplify calculation and determine approximate values.

[Problem to Be Solved]

By using a CPU with a slow processing time, conventional dive computers are unable to quickly compute the non-decompression limit at the same rate the depth is measured, that is, every second, and there is a several second delay until the results are displayed. Depth measurements must therefore be delayed to a commensurate interval of several seconds, thus diminishing the effectiveness of the dive computer.

Furthermore, advances in diving theory have increased the number of theoretical tissue compartments that must be considered when calculating the non-decompression limit from 9 to 16. In addition, the mixture of nitrogen and oxygen in the tank is variable, and helium may also be added to the breathing mix. These factors each increase the number of calculations that must be performed by the dive computer, and exceed the processing capacity of conventionally used CPUs.

Other objects and attainments together with a fuller understanding of the invention will become apparent and appreciated by referring to the following description and claims taken in conjunction with the accompanying drawings.

OBJECTS OF THE INVENTION

The present invention is therefore directed to solving these problems, and an object of this invention is to enable rapidly calculating the non-decompression limit at the current depth by reducing the number of operations performed and shortening the computing time.

SUMMARY OF THE INVENTION

To achieve this object a data processing apparatus for divers according to the present invention has a computing means for repeatedly calculating a non-decompression limit for each tissue compartment (type of body tissue) based on the amount of inert gas accumulated in vivo in conjunction with diving, and a determination means for determining the tissue compartment computing sequence according to which the computing means calculates the non-decompression limit. The computing means calculates the non-decompression limit for each tissue compartment according to the computing sequence determined by the determination means.

Preferably, the determination means sets the current tissue compartment computing sequence in ascending sequence based on the absolute value of the difference to the saturation half-time of the tissue compartment having the lowest calculated non-decompression limit as determined by the computing means during the previous computing process.

Yet further preferably, a tissue compartment number is assigned to each tissue compartment in ascending or descending sequence based on the saturation half-time of each tissue compartment, and the determination means sets the current tissue compartment computing sequence in a tissue compartment number sequence determined by alternately subtracting and adding one, or alternately adding and subtracting one, to the tissue compartment number of the tissue compartment having the lowest calculated non-decompression limit as determined by the computing means during the previous computing process.

A further aspect of the present invention is a data processing apparatus for divers wherein calculating the non-decompression limit for a given tissue compartment ends if during calculation the non-decompression limit for the given tissue compartment exceeds the lowest non-decompression limit computed for another tissue compartment when calculating the non-decompression limit for each tissue compartment according to whether, while repeatedly hypothetically adding a specific time to the dive time, an amount of inert gas accumulated in vivo after adding the specific time exceeds a maximum tolerated inert gas partial pressure in any tissue compartment.

A further data processing apparatus for divers according to the present invention has a computing means for calculating a non-decompression limit for each tissue compartment based on an amount of inert gas accumulated in vivo in conjunction with diving, wherein the computing means does not calculate the non-decompression limit for a tissue compartment if the amount of inhaled inert gas in the breathing mix used by the diver is less than the maximum tolerated inert gas partial pressure of the tissue compartment.

A further data processing apparatus for divers according to the present invention has an inhaled gas computing means for calculating an amount of inhaled inert gas in a breathing mix used by the diver; an in vivo gas updating means for regularly updating the amount of inert gas accumulated in vivo based on the amount of inhaled inert gas calculated by the inhaled gas computing means; and a non-decompression limit computing means for repeatedly calculating the non-decompression limit for each tissue compartment based on the amount of in vivo inert gas updated by the in vivo gas updating means. The non-decompression limit computing means sets the current non-decompression limit to the previous non-decompression limit when the time to calculate the current non-decompression limit is not the time for the in vivo gas updating means to update the amount of in vivo inert gas, and the currently measured amount of inhaled inert gas is equal to the previously measured amount of inhaled inert gas.

A further data processing apparatus for divers according to the present invention has an inhaled gas computing means for calculating an amount of inhaled inert gas in a breathing mix used by the diver; an in vivo gas updating means for regularly updating the amount of inert gas accumulated in vivo based on the amount of inhaled inert gas calculated by the inhaled gas computing means; and a non-decompression limit computing means for repeatedly calculating a non-decompression limit for each tissue compartment based on the amount of in vivo inert gas updated by the in vivo gas updating means. When the time to calculate the current non-decompression limit is the time for the in vivo gas updating means to update the amount of in vivo inert gas, the currently measured amount of inhaled inert gas is equal to the previously measured amount of inhaled inert gas, and the previous non-decompression limit is lower than a predefined maximum non-decompression limit, the non-decompression limit computing means sets the current non-decompression limit to the previous non-decompression limit minus the time elapsed from calculating the previous non-decompression limit to calculating the current non-decompression limit.

A further data processing apparatus, for divers according to the present invention has a computing means for calculating a non-decompression limit for each tissue compartment based on the amount of inert gas accumulated in vivo in conjunction with diving. When the amount of inhaled inert gas contained in a breathing mix used by the diver is greater than or equal to a maximum tolerated inert gas partial pressure for the tissue compartment, the computing means hypothetically repeatedly adds a specific time to the diver's dive time, and sets the non-decompression limit to the dive time at which the amount of inert gas accumulated in vivo after adding the specific time exceeds the maximum tolerated inert gas partial pressure.

A data processing method for a data processing apparatus for divers according to the present invention has a computing step for repeatedly calculating a non-decompression limit for each tissue compartment based on the amount of inert gas accumulated in vivo in conjunction with diving; and a determination step for determining a tissue compartment computing sequence whereby the computing step calculates the non-decompression limit. The computing step calculates the non-decompression limit for each tissue compartment according to the computing sequence determined by the determination step.

A further data processing method for a data processing apparatus for divers determines whether to compute the non-decompression limit for each tissue compartment by repeatedly hypothetically adding a specific time to the dive time and detecting if the amount of inert gas accumulated in vivo after adding the specific time exceeds a maximum tolerated inert gas partial pressure in any tissue compartment, and stops calculating the non-decompression limit for a given tissue compartment if during calculation the non-decompression limit for the given tissue compartment exceeds the lowest non-decompression limit computed for another tissue compartment.

In a further data processing method for a diver's data processing apparatus for calculating a non-decompression limit for each tissue compartment based on an amount of inert gas accumulated in vivo in conjunction with diving, the non-decompression limit for a particular tissue compartment is not calculated if the amount of inhaled inert gas in the breathing mix used by the diver is less than the maximum tolerated inert gas partial pressure of the tissue compartment.

A yet further data processing method for a diver's data processing apparatus has an inhaled gas computing step for calculating an amount of inhaled inert gas in a breathing mix used by the diver; an in vivo gas updating step for regularly updating the amount of inert gas accumulated in vivo based on the amount of inhaled inert gas calculated by the inhaled gas computing step; and a non-decompression limit computing step for repeatedly calculating the non-decompression limit for each tissue compartment based on the amount of in vivo inert gas updated by the in vivo gas updating step. The non-decompression limit computing step sets the current non-decompression limit to the previous non-decompression limit when the time to calculate the current non-decompression limit is not the time for the in vivo gas updating step to update the amount of in vivo inert gas, and the currently measured amount of inhaled inert gas is equal to the previously measured amount of inhaled inert gas.

A yet further data processing method for a diver's data processing apparatus has an inhaled gas computing step for calculating an amount of inhaled inert gas in a breathing mix used by the diver; an in vivo gas updating step for regularly updating the amount of inert gas accumulated in vivo based on the amount of inhaled inert gas calculated by the inhaled gas computing step; and a non-decompression limit computing step for repeatedly calculating a non-decompression limit for each tissue compartment based on the amount of in vivo inert gas updated by the in vivo gas updating step. When the time to calculate the current non-decompression limit is the time for the in vivo gas updating step to update the amount of in vivo inert gas, the currently measured amount of inhaled inert gas is equal to the previously measured amount of inhaled inert gas, and the previous non-decompression limit is lower than a predefined maximum non-decompression limit, the non-decompression limit computing step sets the current non-decompression limit to the previous non-decompression limit minus the time elapsed from calculating the previous non-decompression limit to calculating the current non-decompression limit.

In a yet further data processing method for a diver's data processing apparatus according to the present invention for calculating a non-decompression limit for each tissue compartment based on an amount of inert gas accumulated in vivo in conjunction with diving, when an amount of inhaled inert gas contained in a breathing mix used by a diver is greater than or equal to a maximum tolerated inert gas partial pressure for the tissue compartment, a specific time is hypothetically repeatedly added to the diver's dive time, and the non-decompression limit is set to the dive time at which the amount of inert gas accumulated in vivo after adding the specific time exceeds the maximum tolerated inert gas partial pressure.

A further aspect of the present invention is a program for achieving in a computer a determination function for determining a tissue compartment computing sequence for calculating a non-decompression limit for each tissue compartment; and a computing function for calculating a non-decompression limit for each tissue compartment according to the computing sequence set by the determination function based on an amount of inert gas accumulated in vivo in conjunction with diving.

A further program according to the present invention achieves in a computer a function for stopping calculation of the non-decompression limit for a given tissue compartment if during calculation the non-decompression limit for the given tissue compartment exceeds the lowest non-decompression limit computed for another tissue compartment when calculating the non-decompression limit for each tissue compartment according to whether, while repeatedly hypothetically adding a specific time to the dive time, an amount of inert gas accumulated in vivo after adding the specific time exceeds a maximum tolerated inert gas partial pressure in any tissue compartment.

A further aspect of a program according to the present invention achieves in a computer a computing function for not calculating the non-decompression limit for a given tissue compartment if the amount of inhaled inert gas in the breathing mix used by the diver is less than the maximum tolerated inert gas partial pressure of the tissue compartment when calculating the non-decompression limit for each tissue compartment based on an amount of inert gas accumulated in vivo in conjunction with diving.

A further aspect of a program according to the present invention achieves in a computer an inhaled gas computing function for calculating an amount of inhaled inert gas in a breathing mix used by the diver; an in vivo gas updating function for regularly updating the amount of inert gas accumulated in vivo based on the amount of inhaled inert gas calculated by the inhaled gas computing function; and a non-decompression limit computing function for repeatedly calculating the non-decompression limit for each tissue compartment based on the amount of in vivo inert gas updated by the in vivo gas updating function. The current non-decompression limit is set to the previous non-decompression limit when the time to calculate the current non-decompression limit is not the time for the in vivo gas updating function to update the amount of in vivo inert gas, and the currently measured amount of inhaled inert gas is equal to the previously measured amount of inhaled inert gas.

A further aspect of a program according to the present invention achieves in a computer an inhaled gas computing function for calculating an amount of inhaled inert gas in a breathing mix used by the diver; an in vivo gas updating function for regularly updating the amount of inert gas accumulated in vivo based on the amount of inhaled inert gas calculated by the inhaled gas computing function; and a non-decompression limit computing function for repeatedly calculating a non-decompression limit for each tissue compartment based on the amount of in vivo inert gas updated by the in vivo gas updating function. In this aspect of the program the current non-decompression limit is set to the previous non-decompression limit minus the time elapsed from calculating the previous non-decompression limit to calculating the current non-decompression limit when the time to calculate the current non-decompression limit is the time for the in vivo gas updating function to update the amount of in vivo inert gas, the currently measured amount of inhaled inert gas is equal to the previously measured amount of inhaled inert gas, and the previous non-decompression limit is lower than a predefined maximum non-decompression limit.

A further aspect of a program according to the present invention achieves in a computer a function for calculating a non-decompression limit for each tissue compartment based on an amount of inert gas accumulated in vivo in conjunction with diving. When the amount of inhaled inert gas contained in a breathing mix used by a diver is greater than or equal to a maximum tolerated inert gas partial pressure for the tissue compartment, a specific time is hypothetically repeatedly added to the diver's dive time, and the non-decompression limit is set to the dive time at which the amount of inert gas accumulated in vivo after adding the specific time exceeds the maximum tolerated inert gas partial pressure.

A yet further aspect of the present invention is a computer-readable data storage medium for recording a program as described above.

Other objects and attainments together with a fuller understanding of the invention will become apparent and appreciated by referring to the following description and claims taken in conjunction with the accompanying drawings.

BRIEF DESCRIPTION OF THE DRAWINGS

In the drawings wherein like reference symbols refer to like parts.

FIG. 3 is a table showing the saturation half-time Th of the inert gases nitrogen and helium and the maximum tolerated partial pressure M0 for the sixteen tissue compartments.

FIG. 6 shows the results of the first time the computing process is run by the first embodiment of the invention.

DESCRIPTION OF THE PREFERRED EMBODIMENTS

Preferred embodiments of the present invention are described below with reference to the accompanying figures.

A: Embodiment 1

A-1: Configuration (1) Dive Computer Appearance

Figure 1:
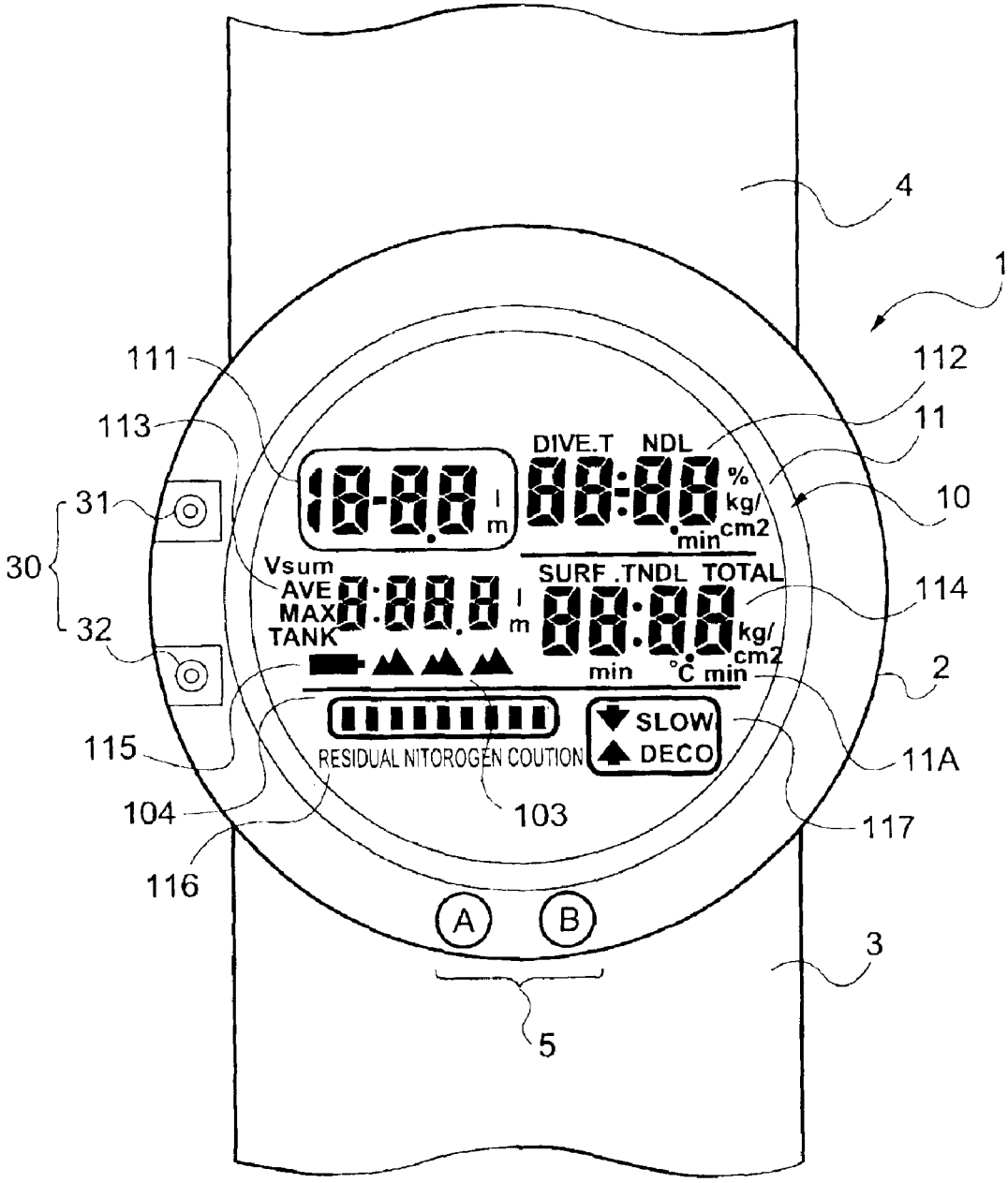
FIG. 1 is a schematic view showing the front of a dive computer according to a first preferred embodiment of the present invention.

FIG. 1 is a schematic diagram showing the front appearance of a data processing apparatus for a diver (dive computer, below) 1 according to this embodiment of the invention. This dive computer 1 calculates and displays the diving depth and dive time for the user (diver) while diving, measures and expresses the amount of inert gas (assumed below to be nitrogen) accumulated in vivo, i.e. in real time, while diving in terms of partial pressure, and displays the non-decompression limit NDL (how long a diver can dive without requiring decompression or danger of suffering decompression illness) calculated from the nitrogen partial pressure.

As shown in FIG. 1 this dive computer 1 has wristbands 3 and 4 attached to a circular body 2 at the top and bottom as seen in the figure, and is worn on the wrist similarly to a wristwatch by these wristbands 3 and 4.

The top case and bottom case of the body 2 are fastened with screws for water resistance to a specific diving depth. The electronic components (not shown in the figure) are housed inside the body 2.

A display unit 10 with an LCD panel 11 is provided at the front of the body 2, and operating controls 5 for selecting and switching the various operating modes of the dive computer 1 are provided at the bottom as seen in FIG. 1. The operating controls 5 in this example are two push-button switches A and B.

A dive mode monitoring switch 30 using a conductive sensor and provided at the left side of the body 2 as seen in FIG. 1 automatically detects when diving starts. This dive mode monitoring switch 30 has two electrodes 31, 32 disposed on the face of the body 2. When immersion in water creates conductivity between these electrodes 31, 32 so that resistance between the electrodes 31, 32 drops, the dive computer 1 knows that it has entered the water.

The configuration of the display unit 10 is described in further detail below.

As shown in FIG. 1 the LCD panel 11 has a display area 11A in the middle that is further subdivided into first to seventh display areas 111 to 117.

Information displayable in first to seventh display areas 111 to 117 includes the current date, current time, dive date, planned dive depth, current depth, maximum depth, depth rank, dive time, dive start and end times, inert gas release time, dive safety factor, non-decompression limit, surface stop time, temperature, power supply warning, altitude rank, inert gas absorption/release tendency, rapid ascent warning, and decompression diving warning.

(2) Electrical Configuration of the Dive Computer 1

The electrical configuration of the dive computer 1 is described next with reference to the block diagram thereof in FIG. 2.

Figure 2:
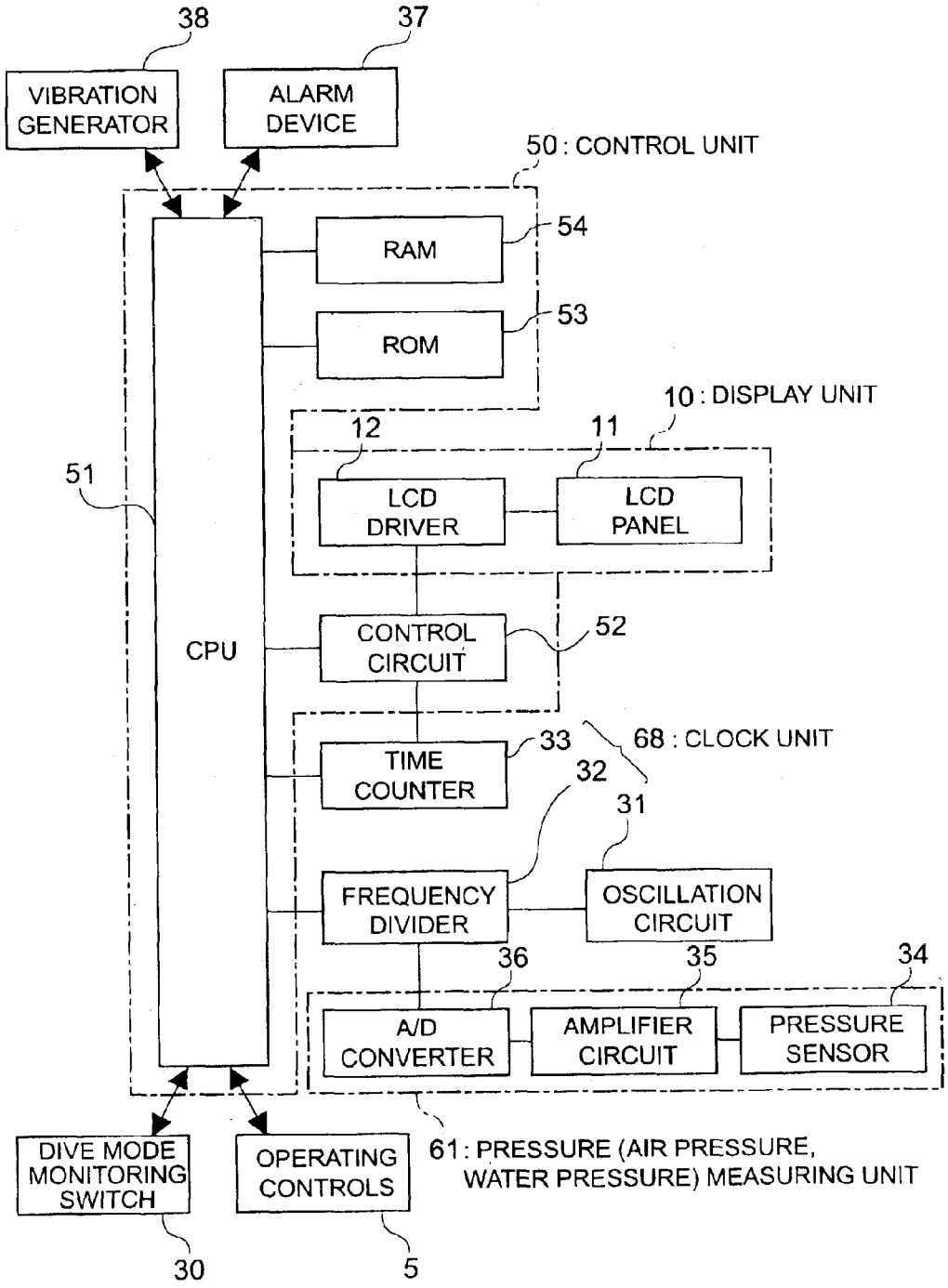
FIG. 2 is a block diagram showing the electrical configuration of a dive computer according to the first embodiment of the invention.

As shown in FIG. 2 this dive computer 1 has operating controls 5 for operating the dive computer 1, display unit 10 for displaying information, dive mode monitoring switch 30, alarm device 37 for issuing audible warnings to the diver by means of a buzzer, for example, vibration generator 38 for warning the diver by means of vibrations, a control unit 50 providing overall control of the dive computer 1, a pressure measuring unit (i.e. pressure gauge) 61 for measuring air pressure or water pressure, and a clock unit 68 for handling time operations.

The display unit 10 has an LCD panel 11 for displaying information, and an LCD driver 12 for driving the LCD panel 11.

The operating controls 5, dive mode monitoring switch 30, alarm device 37, and vibration generator 38 are connected to the control unit 50. The control unit 50 consists of a CPU 51, control circuit 52, ROM 53, and RAM 54. The CPU 51 controls overall operation of the dive computer 1. The control circuit 52 is also controlled by the CPU 51 and runs processes for controlling the operating modes of a time counter 33 and the operation of the LCD driver 12 to display information on the LCD panel 11 according to the selected operating mode. The ROM 53 stores the control program and control data, and RAM 54 temporarily stores data. The CPU 51 reads the control program and control data from ROM 53 and runs the read program.

From the depth (or water pressure) and dive time the dive computer 1 must be able to measure, display, and report the depth to the diver, and measure the amount of inert gas accumulated in the diver's tissues. The pressure measuring unit (i.e. pressure gauge) 61 therefore measures, both air pressure and water pressure. The pressure measuring unit 61 has a semiconductor pressure sensor 34, an amplifier circuit 35 for amplifying the output signal from the pressure sensor 34, and an A/D converter 36 for converting the analog output signal from the amplifier circuit 35 to a digital signal, and outputting the digital pressure signal to the control unit 50.

In order to measure time and monitor dive time in the dive computer 1, the clock unit 68 has an oscillation circuit 31 for generating a clock signal of a specific frequency, a frequency divider 32 for frequency dividing the clock signal output from the oscillation circuit 31, and a time counter 33 for running a timing process in 1-second units based on the output signal from the frequency divider 32.

(3) Saturation Half-Time and Maximum Tolerated Partial Pressure for Different Tissue Compartments, i.e. Tissue Types.

The saturation half-time and maximum tolerated partial pressure of inert gases are described next below.

Different body tissues absorb and release inert gases at different rates and are therefore commonly referred to as "fast" tissues and "slow" tissues. Generally speaking, the speed at which a given tissue becomes saturated at a new pressure is determined by how fast the inert gas is absorbed into the tissues and the rate of blood flow. For example, because there is less blood flow in fatty tissue the time to saturation is longer. Blood flow to the brain, however, is greater and brain tissues are therefore more quickly saturated. The blood and brain, therefore, are considered fast tissues, and the marrow, cartilage, and fatty tissue are considered slow tissues. The saturation half-time and maximum tolerated inert gas partial pressure (saturation limit) are indices indicative of such tissue differences. Albert Buhlmann, as discussed above, proposes compartmentalizing tissue into 16 different tissue compartments, or tissue types. It should be noted that classification of, these tissue compartments is based on a theoretical classification mathematically approximating changes within the tissues due to pressure, and there is no direct 1:1 correlation between these theoretical tissue compartments and the actual brain, marrow, and other tissues.

FIG. 3 is a table showing the saturation half-times Th for the inert gases nitrogen and helium, and the maximum tolerated nitrogen and helium partial pressure M0 in each of these 16 tissue compartments. The tissue compartments COMPn are ranked from 1 to 16 in ascending order from the shortest to highest nitrogen half-time.

It will be understood from FIG. 3 that as the nitrogen half-time Th increases the maximum tolerated partial pressure M0 decreases, and tissues with a faster half-time Th to saturation have a higher maximum tolerated partial pressure M0.

The values from this Table 1 shown in FIG. 3 are stored in a tissue compartment table 53*a* in the ROM 53 of dive computer 1.

(4) Calculating the in vivo, i.e. Real-Time, Inert Gas Partial Pressure

Calculating the in vivo nitrogen partial pressure is described below using nitrogen by way of example as the inert gas.

The general method used by dive computer 1 according to this embodiment of the invention to calculate the in vivo nitrogen partial pressure is known from the literature. See, for example, "Dive Computers, A Consumer's Guide to History, Theory, and Performance," Ken Loyst, et al. incorporated herein by reference, Watersport Publishing Inc. (1991) incorporated herein by reference, and particularly page 14 in "Decompression-Decompression Sickness," A. A. Buhlmann, Springer, Berlin (1984) also incorporated herein by reference. It will be further noted that the method for calculating nitrogen partial pressure described here is by way of example only and other methods may be used.

First, the inhaled nitrogen partial pressure Pa(t), that is, the partial pressure of nitrogen in the gas mix being breathed by the diver (the "breathing mix" below), is calculated based on depth d(t) at time t from the following equation (1).

$$Pa\ (t)=(10+d(t))*(1-\mathrm{FO2})[msw] \tag{1}$$

where FO2 is a number denoting the percentage of oxygen in the breathing mix, and is below referred to as the oxygen ratio. (1−FO2) is a value denoting the percentage of inert gas in the breathing mix, and because it is assumed that the breathing mix contains only oxygen and nitrogen (1−FO2) effectively denotes the percentage of nitrogen in the breathing mix. Note that msw, the unit of inert gas partial pressure, is based on an atmospheric pressure of 10 msw at an altitude of 0 m (i.e., sea level). Equation (1) can therefore be used without modification if the altitude of the water level where the diving takes place is at sea level (0 m), but if diving at an altitude of 800 m or 1600 m, for example, a smaller value should be substituted for the 10 in equation (1).

Air generally contains nitrogen and oxygen in a volume ratio of approximately 0.79:0.21. Therefore, when a tank is filled with air, this embodiment of the invention uses FO2=0.21.

It will be further noted that so-called nitrox contains a greater percentage of oxygen than does air, generally having a nitrogen:oxygen volume ratio between 0.68:0.32 and 0.64:0.36. Furthermore, trimix is a breathing mix containing nitrogen, oxygen, and helium with a nitrogen:oxygen:helium volume ratio of 0.34:0.16:0.50.

After the inhaled nitrogen partial pressure Pa(t) is determined the in vivo, nitrogen partial pressure PGT(t+Δt) is calculated for each tissue compartment with a different rate of nitrogen absorption and release.

Using a given tissue compartment by way of example, the in vivo nitrogen partial pressure PGT(t+Δt) absorbed and released from dive time t to time (t+Δt) can be calculated from the following equation using the nitrogen partial pressure PGT(t) at computing start time t.

$$PGT(t+\Delta t)=PGT(t)+\{Pa(t)-PGT(t)\}*\{1-\exp(-K\cdot\Delta t/Th)\} \tag{2}$$

where K is an experimentally determined constant, and Th is the saturation half-time of the tissue compartment in question. These half-time values are shown in Table 1 (FIG. 3).

The CPU 51 of dive computer 1 repeatedly performs this calculation of the in vivo nitrogen partial pressure PGT(t) for each tissue compartment at a specific sampling period Δt.

(5) Calculating the Non-Decompression Limit

Calculating the non-decompression limit (NDL) is described next.

The NDL is determining by first calculating the amount of time required to reach each tissue compartment's maximum tolerated inert gas pressure, M0, and then setting NDL equal to the shortest calculated time among all the tissue compartments since decompression sickness can result from any tissue compartment reaching its M0 value (shown in FIG. 3). Therefore for each tissue compartment, COMPn, a lapse time Δt starting from an initial time t required to reach an in vivo nitrogen partial pressure, PGT(t+Δt), equal to its corresponding M0 value, i.e. M0*n*, (as calculated from equation (2)) is determined. The maximum tolerated inert gas partial pressure M0*n* for each tissue compartment COMPn is the maximum inert gas partial pressure at which the diver will not experience bubbling at the water surface(i.e. not suffer decompression sickness).

That is, if in equation (2) PGT(t+Δt) is set equal to M0 and one solves the equation for Δt, then $$\Delta t=-Th*(\ln(1-f))/K \tag{3}$$

where f=(M0−PGT(t))/(Pa(t)−PGT(t)).

In equation (3), Δt is the NDLn for a particular tissue compartment COMPn. Thus, the NDLn for each tissue compartment, COMPn, is calculated from equation (3), and the lowest NDLn value found is used as the overall system NDL.

A-2: Operation

Operation of this dive computer 1 is described next.

When calculating the in vivo nitrogen partial pressure PGTn for each tissue compartment, COMPn, the dive computer 1 uses a value of 0.693 for K in equation (2). For each of the 16 tissue compartments (COMPn, where "n" is 1–16), its corresponding half-time Th value and corresponding maximum tolerated partial pressure M0 value is read from tissue compartment table 53*a* stored in ROM 53.

The sampling frequency (Δt) for calculating in vivo nitrogen partial pressure PGT is one minute in this embodiment of the invention.

Figure 4:
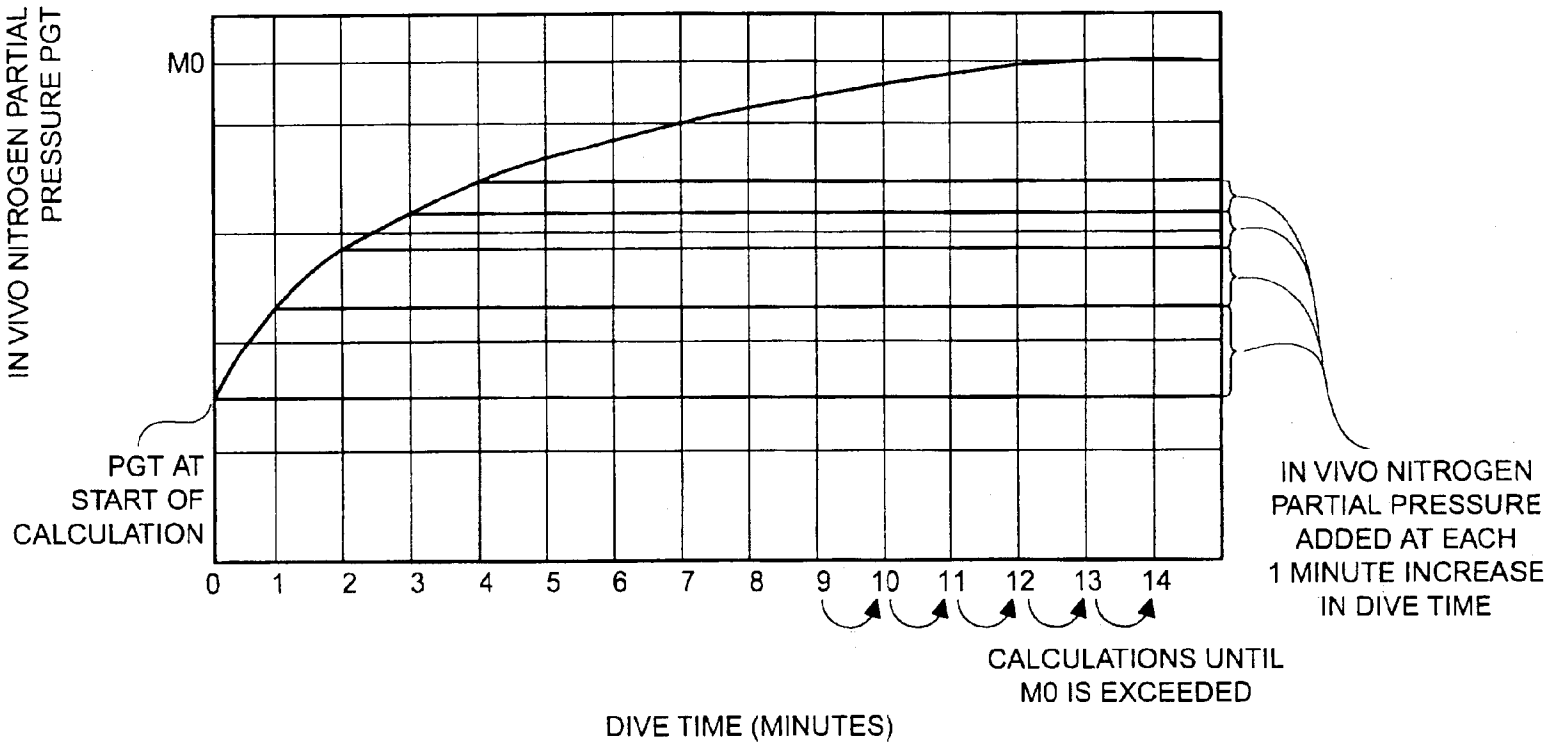
FIG. 4 is a graph showing the relationship between dive time and in vivo nitrogen partial pressure in the first embodiment of the invention.

As shown in FIG. 4, the non-decompression limit NDLn for a particular tissue compartment. COMPn is calculated by hypothetically increasing the dive time in one minute increments beginning from when computing starts, and continuing until the nitrogen partial pressure PGT, which increases according to increasing dive time, exceeds the maximum tolerated partial pressure M0. The dive time at which the nitrogen partial pressure PGT for the particular tissue compartment exceeds its maximum tolerated partial pressure M0 is used as the tissue compartment's non-decompression limit NDLn.

In other words, to calculate each tissue compartment's non-decompression limit NDLn, Δt in equation (2) for each tissue compartment is increased in 1-minute units to calculate the nitrogen partial pressure PGT(t+Δt) at time t+Δt, and the value of Δt at which PGT(t+Δt)>M0 is set as the tissue compartment's non-decompression limit NDLn. This method of computation reduces the number of operations required to determine NDLn from M0*n* as compared to using equation (3).

It should be noted that this first embodiment of the invention initially sets a maximum non-decompression limit NDL of 200 minutes, and computing stops if this limit is exceeded.

To reduce the number of operations performed in the first computational pass, the value of (1−exp(−0.693/Th)) in equation (2) (where Δt=1) is pre-calculated for each tissue compartment and stored as a constant in RAM 54, or alternatively in ROM 53.

In addition, the non-decompression limit display value NDLdisp is preset to 200.

Furthermore, the inhaled nitrogen partial pressure Pa(t) at the dive start time (t=0) and the nitrogen partial pressure PGT1(*t*) to PGT16(*t*) [i.e. PGTn(t)] for tissue compartments 1 to 16 [i.e. COMP1 to COMP16 ] (equal to Pa(t)) are pre-calculated using equation (1) and stored as Pa and PGT1 to PGT16 in RAM 54, or alternatively in ROM 53. The elapsed time since time t=0 is measured by clock unit 68.

Figure 5:
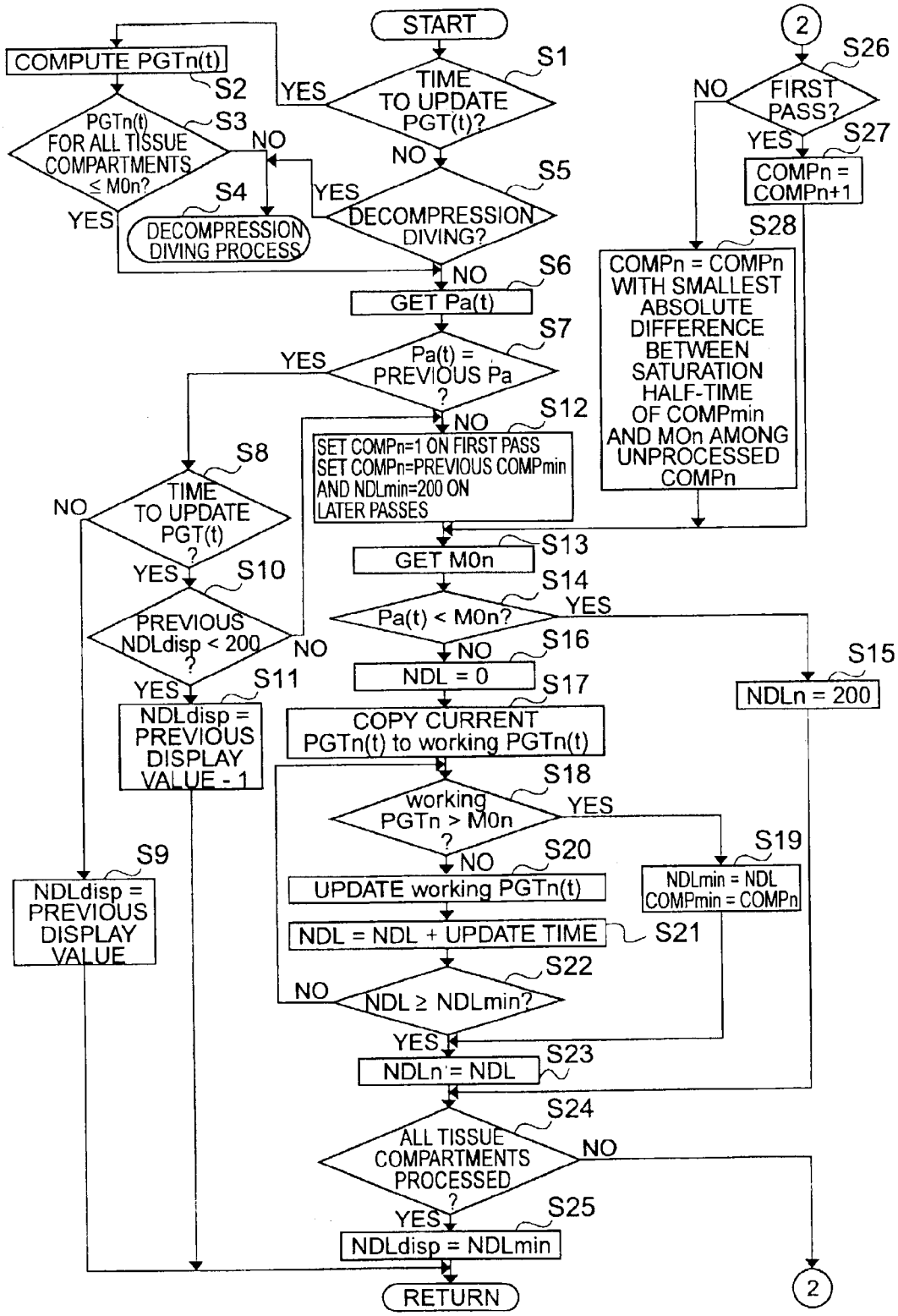
FIG. 5 is a flow chart of the non-decompression limit computing process in the first embodiment of the invention.

FIG. 5 is a flow chart of non-decompression limit NDL computation by the CPU 51 of dive computer 1.

CPU 51 performs different operations during its first, second and subsequent passes calculating the non-decompression limit NDL, and these operations are therefore described separately below. The first pass is used to calculate a first, non-decompression limit display time NDLdisp displayed after a dive starts, and presents the calculated NDLdisp value on the display unit 10 of dive computer 1.

(1) First Pass

The CPU 51 references clock unit 68 to determine if one minute has passed since t=0. If one minute has passed (step S1=yes), it is time to update, the nitrogen partial pressure PGTn(t) stored in RAM 54. Nitrogen partial pressure PGT1 to PGT16 and inhaled nitrogen partial pressure Pa stored in RAM 54 and the saturation half-time Th stored in ROM 53 are then read, nitrogen partial pressure PGT1(1-minute) to PGT16(1-minute) are calculated from equation (2), and PGT1 to PGT16 in RAM 54 are updated to the calculated values (step S2).

The CPU 51 then reads each tissue compartment's nitrogen partial pressure PGTn calculated in step S2 from RAM 54 and the maximum tolerated partial pressure M0*n* from ROM 53, and determines for all tissue compartments if PGTn≦M0*n* (step S3).

If PGTn>M0*n* for any tissue compartment (step S3 returns no) the diver is in a decompression dive and the CPU 51 runs the decompression diving process (step S4). That is, the non-decompression limit display value NDLdisp is set to 0 and displayed on the display unit 10 of dive computer 1, and processing ends.

If PGTn≦M0*n* for all tissue compartments (step S3 returns yes), control moves to step S6.

Returning to step S1, if one minute has not passed since t=0 (step S1 returns no), nitrogen partial pressure PGTn(t) is not calculated and the CPU 51 determines if the diver is in a decompression dive (step S5). That is, the CPU 51 detects if the diver was in a decompression dive the last time PGTn(t) was calculated.

If a decompression dive is detected (step S5 returns yes), the CPU 51 runs the decompression dive process (step S4). If a decompression dive is not detected (step S5 returns no), control moves to step S6.

In step S6 the CPU 51 references pressure measuring unit, i.e. pressure gauge, 61 to get the inhaled nitrogen partial pressure Pa(t), and then determines if this inhaled nitrogen partial pressure Pa(t) and the previous inhaled nitrogen partial pressure Pa stored to RAM 54 are equal (step S7).

If Pa(t)=PREVIOUS Pa (step S7 returns yes), CPU 51 determines if it is time to update nitrogen partial pressure PGTn (step S8).

If it is not time to update nitrogen partial pressure PGTn (step S8 returns no) (and one minute has not passed since t=0), CPU 51 leaves the non-decompression limit display value NDLdisp in RAM 54 set to its previous display value, 200 (step S9), and the first process pass ends.

If it is time to update nitrogen partial pressure PGTn (step S8 returns yes), CPU 51 compares the non-decompression limit display value NDLdisp stored in RAM 54 with 200 (step S10).

The first time the process runs non-decompression limit display value NDLdisp is set to 200, therefore the comparison NDLdisp≧200 of step S10 returns no, and control advances to step S12.

In step S12 the CPU 51 sets the tissue compartment counter COMPn indicating the tissue compartment for which values are to be calculated to 1, and sets the minimum non-decompression limit NDLmin to 200.

CPU 51 then gets maximum tolerated partial pressure M01 for tissue compartment COMP1 from the tissue compartment table 53*a* in ROM 53 (step S13), and compares inhaled nitrogen partial pressure Pa(t) with maximum tolerated partial pressure M01 (step S14).

If Pa(t)<M01 (step S14 returns yes), the diver will not reach maximum tolerated partial pressure M01 even if he continues breathing the mix at inhaled nitrogen partial pressure Pa(t). CPU 51 therefore sets non-decompression limit NDL1 to 200 (step S15), and advances to step S24 to repeat the calculations for the next tissue compartment.

However, if Pa≧M01 (step S14 returns no), CPU 51 initializes a working non-decompression limit NDL variable to 0 in step S16 in order to calculate the non-decompression limit NDLn (i.e. NDL1) for the particular tissue compartment, COMP1 in the present case.

Note that this "working non-decompression limit NDL variable" is a variable for temporarily storing values during the computing process.

CPU 51 then sets nitrogen partial pressure PGT1(*t*) stored in RAM 54 to working PGT1(*t*) (step S17).

Like working non-decompression limit NDL variable, this "working PGT1(*t*)" is also a variable for temporarily storing values during the computing process.

CPU 51 then compares working PGT1($t$) with maximum tolerated partial pressure M01 (step S18).

Because the non-decompression limit has still not been calculated at this time nitrogen partial pressure PGT1($t$) and working PGT1($t$) are equal, and PGT1($t$)≦M01 because step S3 or S5 has already been completed. Step S18 therefore returns no, control advances to step S20, and CPU 51 calculates the non-decompression limit NDLn, i.e. NDL1, for COMP1.

That is, using the measured current water pressure and saturation half-time Th for COMP1 from ROM 53, CPU 51 calculates the nitrogen partial pressure at the time equal to working non-decompression limit NDL variable plus 1 minute from equation (2), and updates working PGT1($t$) to the calculated value (step S20). The working non-decompression limit NDL variable is then incremented 1 minute (step S21).

CPU 51 then compares working non-decompression limit NDL variable with the minimum non-decompression limit NDLmin (step S22). Because minimum non-decompression limit NDLmin is set to 200 at this time, NDL<NDLmin (step S22 returns no), and the procedure loops to step S18.

In step S18 CPU 51 again compares working PGT1($t$) with maximum tolerated partial pressure M01. If working PGT1($t$) is not greater than M01 (step S18 returns no), steps S18 to S22 repeat until working PGT1($t$) is greater than maximum tolerated partial pressure M01. When working PGT1($t$) becomes greater than M01 (step S18 returns yes), the minimum non-decompression limit NDLmin is set to the value of the working non-decompression limit NDL variable. Also, COMPmin, i.e., the tissue compartment number with the lowest non-decompression limit (the "lowest tissue compartment number" below) is set to the current COMPn, "1" in the present case (step S19). Then, the non-decompression limit NDLn for the current tissue compartment, i.e. NDL1 in the present case, is set to the value of the working non-decompression limit NDL variable and stored to RAM 54 (step S23), and control advances to step S24 to run the calculations for the next tissue compartment.

In step S24 CPU 51 determines if calculations were completed for all tissue compartments. Because calculations are completed for only the current tissue compartment number (1) at this time (step S24 returns no), control branches to step S26.

CPU 51 then determines if this was the first time the computing process ran. Because it is (step S26 returns yes), CPU 51 increments the current tissue compartment counter COMPn by 1 to set the number of the next tissue compartment to process (step S27). Because the tissue compartment counter COMPn is currently 1, the next tissue compartment to be processed is tissue compartment 2 (COMP2).

CPU 51 then performs the same operation described above from step S13, and repeats this operation for all tissue compartments.

It should be noted that although the working non-decompression limit NDL variable for COMP1 was less than NDLmin in step S22, this was because the minimum non-decompression limit NDLmin was initially set to a default value of 200. It should be noted that the value of NDLmin was changed to COMP1's highest working non-decompression limit NDL value (step 19) before processing moved on to COMP2. Therefore, When processing tissue compartment COMP2, it may happen that the highest value of COMP2's working non-decompression limit NDL variable may be lower than COMP1's, in which case step S18 will return "yes" before COMP2's NDL value reaches the value of COMP1's NDL as determined by step S22. If this is the case, then step S19 will update NDLmin to be equal to COMP2's NDL value. Therefore, NDLmin will maintain a value equal to the lowest NDLn among all previously processed tissue compartments COMPn. As a result, when processing tissue compartment COMP2 and above, the minimum non-decompression limit NDLmin will have a value equal to the minimum NDLn value determined during the processing of the tissue compartments prior to the current tissue compartment being processed, and it is possible that for the current tissue compartment, NDL≧NDLmin, which means that the NDL value of the current tissue compartment is higher than a that of a previously processed tissue compartment. If this is the case, then NDLmin remains unchanged (step S22 returns yes, and step S19 is skipped).

If NDL≧NDLnin (step S22 returns yes) then a non-decompression limit NDLn of a shorter time or the same time was already calculated for a tissue compartment processed before the tissue compartment currently being processed, and minimum non-decompression limit NDLmin will not change even if processing continues. CPU 51 therefore sets working non-decompression limit NDL to non-decompression limit NDLn (step S23), terminates computing for the current tissue compartment, and moves to step S24 to process the next tissue compartment.

If all tissue compartments have been processed (step S24 returns yes), the non-decompression limit display value NDLdisp is set to the value of the minimum non-decompression limit NDLmin and stored to RAM 54 (step S25). The non-decompression limit display value NDLdisp is displayed on display unit 10 of dive computer 1, and the first process ends.

Specific examples of the calculations in this first process are shown in FIG. 6.

In the computations for tissue compartments 1–3 (i.e. COMP1 through COMP3) in this example, the minimum non-decompression limit NDLmin=40 and the lowest tissue compartment number COMPmin is 1, i.e. COMP1. However, when calculating tissue compartment COMP4, the minimum non-decompression limit NDLmin is changed to 38, and the lowest tissue compartment number COMPmin is therefore updated to 4, i.e. COMP4. Minimum non-decompression limit NDLmin and lowest tissue compartment number COMPmin remain unchanged during the processing of tissue compartments COMP5–COMP16, and the final value for minimum non-decompression limit NDLmin is 38 and, the final value for lowest tissue compartment number COMPmin is 4, i.e. COMP4.

(2) Second and Subsequent Passes

Returning to FIG. 5, CPU 51 references the clock unit 68 to determine if one minute has passed since the last time nitrogen partial pressure PGTn stored in RAM 54 was updated, that is, if it is time to update nitrogen partial pressure PGTn (step S1).

Steps S2 to S9 are the same as during the first pass described above.

If in step S10 the previous display value NDLdisp<200 (step S10 returns yes), CPU 51 decrements NDLdisp by one minute. That is, CPU 51 updates the non-decompression limit display value NDLdisp to a value equal to the non-decompression limit display value NDLdisp stored in RAM 54 minus 1 minute (step S11), displays the updated non-decompression limit display value NDLdisp on display unit 10 of dive computer 1, and ends operation.

If the previously displayed NDLdisp is not less than 200 (step S10 returns no), control advances to step S12.

In step S12 CPU 51 sets COMPn (the tissue compartment to be processed) to the lowest tissue compartment number COMPmin stored to RAM 54 in the previous pass, and sets the minimum non-decompression limit NDLmin to 200.

The reason lowest tissue COMPn is set to compartment number COMPmin, and calculations therefore start from this tissue compartment, COMPn is there is a high likelihood that the tissue compartment number that had the lowest NDLn value in the previous pass through the computing process will also have the lowest non-decompression limit NDLn in the current pass, and it is therefore more efficient to begin calculations from the tissue compartment COMPn that had the lowest non-decompression limit NPLn in the previously pass.

For example, if the current process is the second pass and the results from the first pass are as shown in FIG. 6, lowest tissue compartment number COMPmin=4 and tissue compartment COMPn is therefore set to 4, i.e. COMP4.

Steps S13 to S25 then proceed as described in the first pass above.

In step S26, CPU 51 checks if the current process pass is the first pass through, and if it is the second or subsequent pass (step S26 returns no). CPU 51 then selects for processing the tissue compartment COMPn whose saturation half-time is closest to the saturation half-time of the tissue compartment COMPmin, which was previously identified as having the lowest NDLn value, i.e. having NDLmin. In other words, CPU5 sets COMPn equal to the tissue compartment whose absolute value of the difference between its corresponding saturation half-time and the saturation half-time of lowest tissue compartment number COMPmin ($|\Delta th|=th_{COMPmin}-th_n|$) is lowest among the not yet processed tissue components (step S28).

This method of determining the tissue compartment is derived from experience, which provides a rule of thumb specifying that the probability is high that the tissue compartment with a saturation half-time close to the saturation half-time of the tissue compartment that had the lowest non-decompression limit in the previous process cycle, will likely have the lowest non-decompression limit in the next process cycle.

For example, if the tissue compartment numbers are listed in order from the lowest absolute difference of its saturation half-time to the saturation half-time Th (Th4=18.5 minutes) of the lowest tissue compartment number COMPmin (=COMP4) using the data of FIGS. 3 and 6, the computing sequence becomes: COMPn=3 (Th3=12.5 min, |Δth|=6 min); COMPn=5 (Th5=27 min, |Δth|=8.5 min); COMPn=2 (Th2=8 min, |Δth|=10.5 min); COMPn=1 (Th1=4 min, |Δth|=14.5 min); COMPn=6 (Th6=38.3 min, |Δth|=19.8 min); COMPn=7 (Th7=54.3 min, |Δth|=35.8 min); COMPn=8 (Th8=77 min, |Δth|=58.5 min), and so on.

This first embodiment of the present invention thus permits efficient calculation of the overall non-decompression limit NDL for the system by eliminating unnecessary operations as much as possible, by:

(1) stopping computation when the non-decompression limit NDLn of tissue component being processed reaches the current minimum non-decompression limit NDLmin or reaches a new lower value for the minimum non-decompression limit NDLmin;

(2) in the second and subsequent passes, determining the tissue compartment COMPn for which the non-decompression limit NDLn is computed next by finding the difference |Δth | between the saturation half-time of each unprocessed tissue compartment and the saturation half-time of the tissue compartment corresponding to the current COMPmin, and selecting the tissue compartment COMPn for which the absolute value of this difference, |Δth|, is smallest;

(3) not calculating the non-decompression limit NDL when inhaled nitrogen partial pressure Pa is less than the maximum tolerated partial pressure M0;

(4) skipping the calculations and setting the current non-decompression limit to the previously defined non-decompression limit (step S9) when the current time (when the non-decompression limit was to be calculated) is not the time to update the nitrogen partial pressure (step S8) and the measured inhaled nitrogen partial pressure is equal to the previous inhaled nitrogen partial pressure (step S7); and (5) when it is time to update the non-decompression limit NDL (step S8=yes), updating the NDL to the previous non-decompression limit minus the time lapse since the last NDL update (i.e. 1 minute in the present example) if the measured inhaled nitrogen partial pressure is equal to the previous inhaled nitrogen partial pressure (step S7) and the previous non-decompression limit is less than the maximum non-decompression limit (200 minutes) (step S10).

It is therefore possible to reduce the time lag from measuring the water pressure to displaying the non-decompression limit NDL, and more accurate information can therefore be provided for the diver.

Power consumption is also reduced by reducing the number of calculations. Battery life can therefore be extended, and a smaller dive computer 1 can be achieved.

By thus providing the diver with accurate information, preventing battery failure while diving as a result of extending battery life, and improving portability by making the dive computer 1 smaller, this embodiment of the present invention helps enable safe diving.

It should be noted that while the first embodiment of the invention described above runs the calculations in sequence from the lowest tissue compartment number in the first pass described above, any sequence can be used in this first pass because it is still not known which tissue compartment has the lowest non-decompression limit NDL.

B: Embodiment 2

B-1: Configuration

The circuit configuration of this second embodiment is substantially similar to the circuit configuration of the first embodiment other than the program stored to ROM 53, and further description thereof is thus omitted below.

B-2:

The operation of a dive computer 1 according to this second embodiment of the invention is described next below.

Figure 7A:
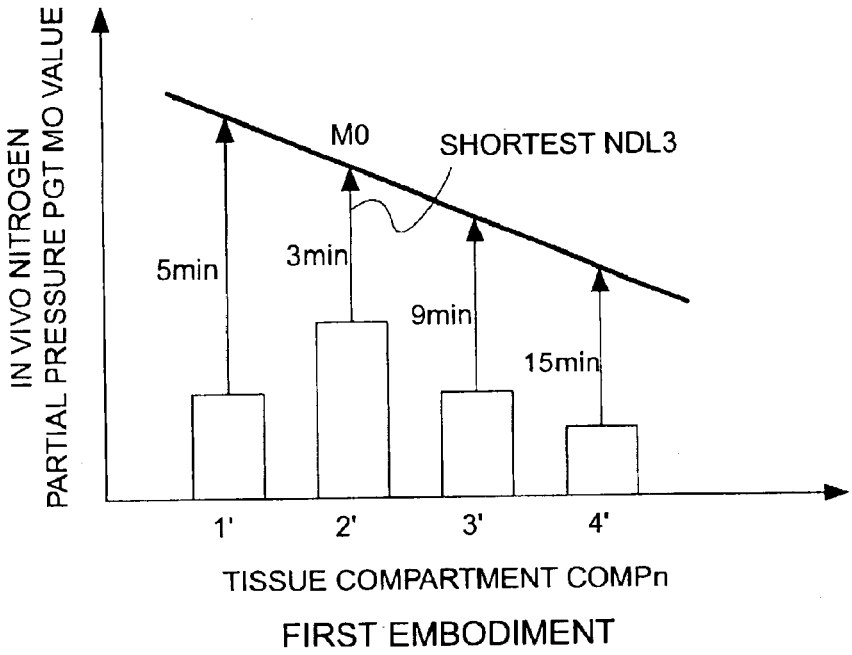
FIG. 7 is used to describe the computing method of a second embodiment of the invention.
Figure 7B:
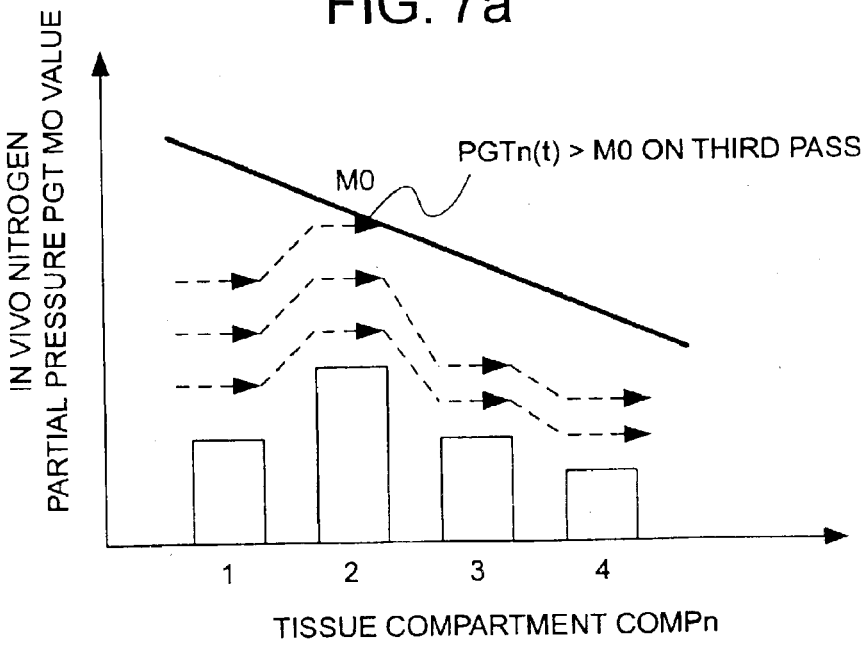

In the first embodiment, as shown in FIG. 7(*a*), nitrogen partial pressure PGTn(t) is calculated by hypothetically incrementing the dive time in one minute intervals for each tissue compartment. In this second embodiment as shown in FIG. 7(*b*), however, nitrogen partial pressure PGTn(t) is calculated for each tissue compartment each time the dive time is hypothetically incremented by one minute.

With the method of the first embodiment it therefore takes a total of 14 computations in the first pass to calculate the non-decompression limit NDL, that is, 5 times for tissue compartment 1 and three times each for tissue compartments 2, 3, and 4 as shown in FIG. 7(*a*). With the method of this second embodiment as shown in FIG. 7(*b*), however, only 10 computations are needed, three each for tissue compartments 1 and 2, and two each for tissue compartments 3 and 4.

As in the first embodiment the computations performed by dive computer 1 use a value of 0.693 for K in equation (2) to determine nitrogen partial pressure PGTn in each tissue compartment. Furthermore, the values read from tissue compartment table 53*a* in ROM 53 are used for the saturation half-times $Th_n$ and maximum tolerated partial pressure M0*n* of the sixteen tissue compartments, the sampling interval (Δt) for calculating nitrogen partial pressure PGT is 1 minute, the maximum non-decompression limit is 200 minutes, and computing stops when this maximum is exceeded.

To reduce the number of operations performed in the first pass the value of (1−exp(−0.693/Th)) in equation (2) is pre-calculated for each tissue compartment and stored as a constant in RAM 54.

In addition, the non-decompression limit display value NDLdisp is preset to 200.

Furthermore, the inhaled nitrogen partial pressure Pa(t) at the dive start time (t=0) and the nitrogen partial pressure PGT1(*t*) to PGT16(*t*) for tissue compartments 1 to 16 (equal to Pa(t)) are pre-calculated using equation (1) and stored as Pa and PGT1 to PGT16 in RAM 54. Time passed since time t=0 is measured by the clock unit 68.

Figure 8:
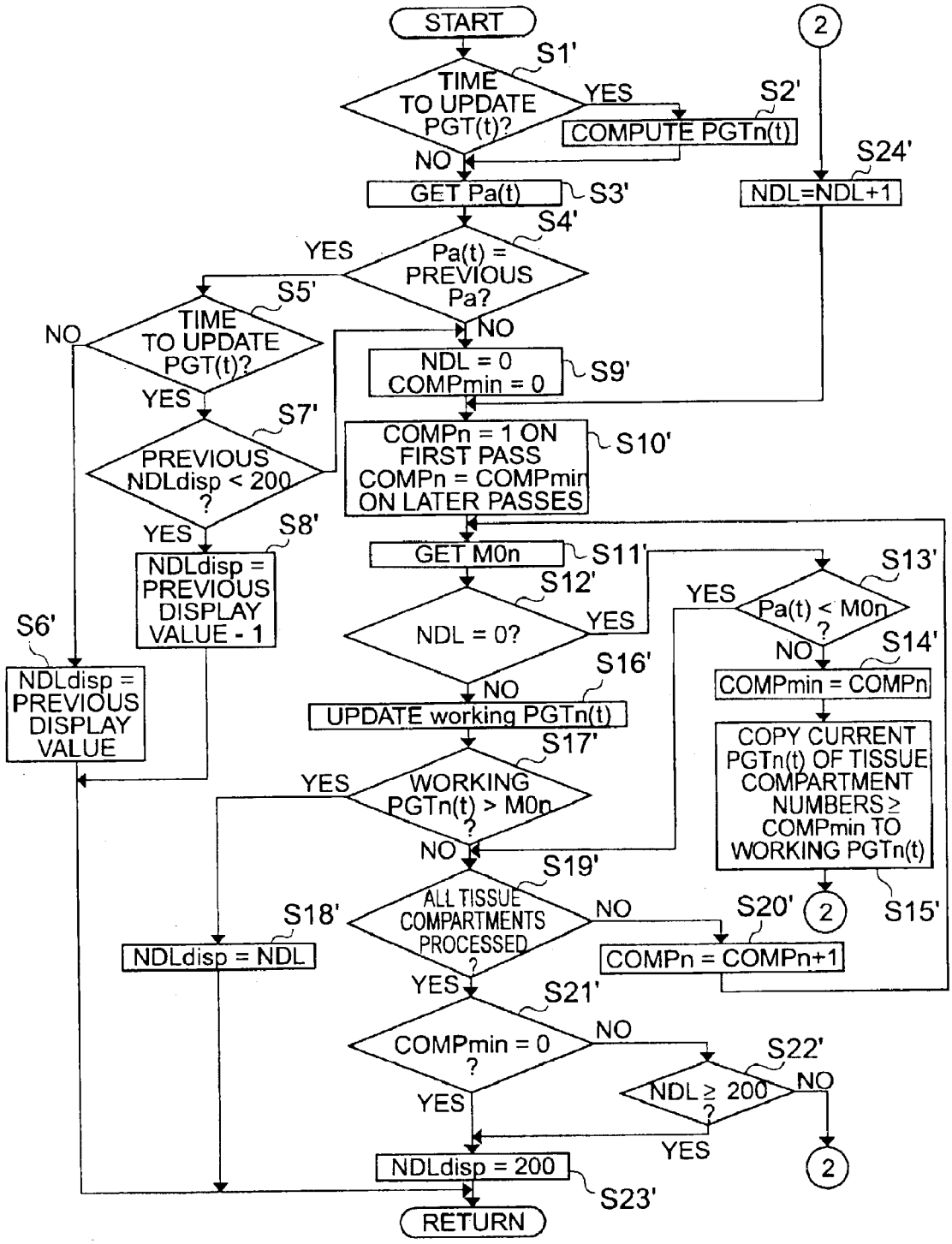
FIG. 8 is a flow chart of the non-decompression limit computing process in the second embodiment of the invention.

FIG. 8 is a flow chart of non-decompression limit NDL computation by the CPU 51 of dive computer 1.

CPU 51 performs different operations during the first pass and second and subsequent passes calculating the non-decompression limit NDL, and these operations are therefore described separately below. In the first pass in this embodiment the working non-decompression limit NDL=0, and in the second and subsequent processes the working non-decompression limit NDL is 1 minute or more depending on the number of previous passes.

Steps S1' to S8' are similar to steps S1 through S8 of the first embodiment, and further description thereof is thus omitted below. In step S9' CPU 51 initializes the working non-decompression limit NDL to 0 and initializes the assigned value of the lowest tissue compartment number COMPmin variable to 0.

(1) First Pass

In the first pass, step S10' CPU 51 sets the tissue compartment counter COMPn to the number of the first tissue compartment to process (1).

CPU 51 then gets the maximum tolerated partial pressure M01 of tissue compartment number 1 from tissue compartment table 53*a* in ROM 53 (step S11'), and determines if the working non-decompression limit NDL is 0 (step S12').

Because the working non-decompression limit NDL is 0 in this first pass (step S12' returns yes), CPU 51 compares inhaled nitrogen partial pressure Pa(t) and maximum tolerated partial pressure M01 (step S13').

If Pa(t)≧M01 (step S13' returns no), CPU 51 sets lowest tissue compartment number COMPmin to the current tissue compartment number (1) for calculating the non-decompression limit NDL (step S14'), and then copies the current nitrogen partial pressure PGT1(*t*) to PGT16(*t*) stored in RAM 54 from all tissue compartments having a tissue compartment number greater than or equal to current value, 1, (that is, all tissue compartments in this case) to corresponding working variables PGT1(*t*) to working PGT16(*t*) (step S15'). CPU 5 also increases the working non-decompression limit NDL variable by 1 minute at step S24' for the second and subsequent passes.

However if Pa(t)<M01 (step S13' returns yes), the diver will not reach maximum tolerated partial pressure M01 even if he continues breathing the mix at inhaled nitrogen partial pressure Pa(t). CPU 51 therefore stops computation for the current tissue compartment number (1), and determines if the calculations have been completed for all tissue compartments in preparation for processing the next tissue compartment (step S19'). Because processing the current tissue compartment 1 has not ended yet (step S19' returns no), tissue compartment COMP1 is incremented by one (step S20'), and the process loops back to step S11' for tissue compartment 2.

As long as Pa(t)<M0*n* in this case, CPU 51 continues looping from step S11' to S12' to S13' to S19' to S20' and back to S11' for all tissue compartments with a tissue compartment number of 2 or higher. Because step S19' returns yes when running through this loop for the last tissue compartment, CPU 51 advances from step S19' to step S21' where it is determined if lowest tissue compartment number COMPmin=0. Because lowest tissue compartment number COMPmin remains set to 0 in this case (step S21' returns yes), the non-decompression limit display value NDLdisp is set to 200 (step S23'), the non-decompression limit display value NDLdisp is displayed on display unit 10 of dive computer 1, and the first process ends.

If while looping through step S11' to S12' to S13' to S19' to S20' for each tissue compartment, it is determined in step S13' for tissue compartment COMPn that Pa≧M0*n* (step S13' returns no), CPU 51 sets the lowest tissue compartment number COMPmin equal to the current tissue compartment number COMPn to calculate the non-decompression limit NDL (step S14'). CPU 51 then copies the nitrogen partial pressure PGTn(t) from RAM 54 for tissue compartment numbers greater than or equal to COMPn to their corresponding working PGTn(t) variable (step S15'). Afterwards, CPU 51 increases the working non-decompression limit NDL by 1 minute at step S24' to run the process the second or subsequent time.

Because the maximum tolerated partial pressure M0*n* decreases as the tissue compartment COMPn increases, due to the chosen arrangement of COMPn as shown in tissue compartment table 53*a* of Table 1 (FIG. 3), if Pa≧M0*n* for any tissue compartment COMPn, then Pa≧M0*i* for any tissue compartment number COMPi greater than tissue compartment COMPn (where n<i≦16). The comparison in step S13' is therefore skipped for each subsequent tissue compartment COMPi, and the CPU 51 proceeds to step S15'.

Calculations are performed in the second and subsequent passes using the process described below for each tissue compartment COMPn greater than or equal to lowest tissue compartment number COMPmin where Pa≧M0*n*.

(2) Second and Subsequent Passes

In step S24' CPU 51 adds the update time increment, 1 minute, to the working non-decompression limit NDL. Then in step S10' it sets the next tissue compartment COMPn to be processed equal to the lowest tissue compartment number COMPmin from the previous process stored in RAM 54.

Next, CPU 51 reads the maximum tolerated partial pressure M0*n* for tissue compartment COMPn from tissue compartment table 53*a* in ROM 53 (step S11'), and determines if the working non-decompression limit NDL is 0 (step S12').

Because this is the second or subsequent pass and working non-decompression limit NDL is "1 minute" or longer (step S12' returns no), CPU 51 applies equation (2) to calculate the nitrogen partial pressure at 1 minute after the working non-decompression limit NDL of the previous calculation using the measured current water pressure and saturation half-time Th stored in ROM 53. It then updates working PGTn(t) to the calculated value (step S16').

CPU 51 then compares working PGTn(t) with maximum tolerated partial pressure M0*n* (step S17').

If working PGT1(*t*)>M01 (step S17' returns yes), the working non-decompression limit NDL at this time is the minimum non-decompression limit NDL. The non-decompression limit display value NDLdisp is therefore updated to working non-decompression limit NDL (step S18'), the udpated non-decompression limit display value NDLdisp is displayed on the display unit 10 of dive computer 1, and the process ends.

If working PGT1($t$)≦M01 (step S17' returns no), CPU 51 determines if computations have been completed for all tissue compartments (step S19'). If not (step S19' returns no), COMPn is incremented by 1 (step S20'), and operation continues from step S11' for the next tissue compartment.

If calculations are completed for all tissue compartments (step S19' returns yes), it is determined whether lowest tissue compartment number COMPmin=0 (step S21'). Because lowest tissue compartment number COMPmin has been set to a value greater than 0 in the second and subsequent processes (step S21' returns no), whether the working non-decompression limit NDL is greater than or equal to 200 is determined (step S22'). If the working NDL is less than 200 (step S22' returns no), control loops to step S24' to advance the working NDL and calculate information for tissue compartments greater than or equal to COMPmin.

However, if working non-decompression limit NDL is 200 or more (step S22' returns yes), CPU 51 sets non-decompression limit display value NDLdisp to 200 (step S23'), displays the non-decompression limit display value NDLdisp on display unit 10 of dive computer 1, and ends the process.

It will thus be apparent that this embodiment of the invention greatly reduces the number of calculations performed by repeatedly hypothetically adding a specific time to the working non-decompression limit NDL, calculating the nitrogen partial pressure PGTn(t) to the incremented working non-decompression limit NDL for each tissue compartment, and defining the working non-decompression limit NDL at which the nitrogen partial pressure PGTn(t) for a given tissue compartment exceeds the maximum tolerated partial pressure M0*n* as the non-decompression limit NDL to be displayed.

It should be noted that while a period of 1 minute is used as the update time for nitrogen partial pressure PGT(t) in step S1' and the update time of working non-decompression limit NDL, this period can be appropriately adjusted with consideration for the speed of the CPU 51 and the required accuracy.

Furthermore, the maximum non-decompression limit NDL is set to 200 in the preceding embodiments, but can be set to a value other than 200 with consideration for the speed of the CPU 51 and computing requirements.

C: Variations (1) Determining the Tissue Compartment Computing Sequence

In the first embodiment above the next tissue compartment to process is determined by finding the difference between the saturation half-time Th of lowest tissue compartment number COMPmin and the saturation half-time Th of each unprocessed tissue compartment COMPn, and selecting as the next tissue compartment to process the tissue compartment COMPn for which the absolute value of this difference is smallest. The invention shall not be so limited, however, and other computing sequences considered appropriate based on experience can be used.

For example, the tissue compartment computing sequence could be determined by alternately subtracting and adding, or adding and subtracting, 1 to the tissue compartment number of the tissue compartment with the lowest calculated non-decompression limit NDL during the previous computing process. If COMPmin=4, for example, then the computing sequence for the second or subsequent process using the subtract-add rule is COMPn=3, COMPn=5, COMPn=2, COMPn=6, COMPn=1, COMPn=7, COMPn=8, COMPn=9 . . . COMPn=16. Using the add-subtract rule, the sequence becomes COMPn=5, COMPn=3, COMPn=6, COMPn=2, COMPn=7, COMPn=1, COMPn=8, COMPn=9 . . . COMPn=16.

It should be further noted that the tissue compartment numbers in Table 1 are assigned in order from the lowest saturation half-time but could be assigned in order from the highest saturation half-time while still determining the computing sequence as described above.

(2) Types of Inert Gas

These preferred embodiments of the invention have been described using nitrogen by way of example as the inert gas, but the invention shall not be so limited and other inert gases such as helium can be used. It should be noted, however, that the saturation half-time Th depends upon the type of inert gas used, and saturation half-times Th for helium are as shown in Table 1.

To determine the inert gas partial pressure PGT(t) for trimix as noted above the in vivo nitrogen partial pressure and the in vivo helium partial pressure are first separately determined using equation (2). The resulting nitrogen and helium partial pressures are then added together to obtain the total in vivo inert gas partial pressure. The total in vivo inert gas partial pressure is thus determined for a breathing mix having two or more inert gases by separately calculating the value for each inert gas and then simply finding the sum of the results.

(3) Program Stored in ROM 53

These preferred embodiments of the invention assume that a program controlling the above-described operations is prestored in ROM 53. The invention shall not be so limited, however. For example, a personal computer (not shown in the figure) could be connected to and communicate with the dive computer 1 so that the program can be downloaded from the personal computer to the dive computer 1. In this case the program is preferably written to rewritable non-volatile memory (not shown in the figure), and the CPU 51 reads and runs the program from the rewritable non-volatile memory.

[Effect of the Invention]

It will thus be apparent that a data processing apparatus for a diver according to the present invention can efficiently calculate the non-decompression limit indicating how long a diver can dive without needing decompression.

Although the present invention has been described in connection with the preferred embodiments thereof with reference to the accompanying drawings, it is to be noted that various changes and modifications will be apparent to those skilled in the art. Such changes and modifications are to be understood as included within the scope of the present invention as defined by the appended claims, unless they depart therefrom.

What is claimed is:

1. A data processing apparatus for divers comprising:

a computing means for repeatedly calculating, for a predefined group of tissue compartments, a non-decompression limit for each tissue compartment based on a determination of an amount of inert gas accumulated in vivo in said tissue compartments; and a determination means for determining a tissue-compartment-computing-sequence specifying an order sequence according to which said computing means calculates the non-decompression limit of each tissue compartment;

wherein:

each of said tissue compartments is characterized by a saturation half-time parameter;

said computing device repeatedly cycles through said tissue compartments and sequentially calculates the non-decompression limit of each tissue compartment during each cycle by implementing a separate computing process for each tissue compartment, in sequence, as determined by said tissue-compartment-computing-sequence;

said determination means arranges said tissue compartments within said tissue-compartment-computing-sequence in ascending order based on the absolute value of the difference between the saturation half-time of each tissue compartment during a current cycle and the saturation half-time of the tissue compartment that had the lowest calculated non-decompression limit during the previous cycle as determined by the computing means.

2. A data processing apparatus for divers comprising:

a computing means for repeatedly calculating, for a predefined group of tissue compartments, a non-decompression limit for each tissue compartment based on a determination of an amount of inert gas accumulated in vivo in said tissue compartments; and a determination means for determining a tissue-compartment-computing-sequence specifying an order sequence according to which said computing means calculates the non-decompression limit of each tissue compartment;

wherein a tissue-compartment-number is assigned to each tissue compartment in ascending or descending order based on the saturation half-time of each tissue compartment; and the determination means sets the current tissue-compartment-computing-sequence in accordance with said tissue-compartment-numbers by beginning with the tissue compartment having the lowest calculated non-decompression limit as determined by the computing device during a previous computing process and alternately applying a subtracting sequence and an addition sequence to the tissue-compartment-number of a current tissue compartment to obtain the tissue-compartment-number of a next tissue compartment for arrangement in said tissue-compartment-computing-sequence;

wherein said subtracting sequence consists of subtracting a constant numeral offset from the current tissue compartment number of the current tissue compartment to obtain the next tissue compartment number of the next tissue compartment; and wherein said addition sequence consists of adding said constant numeral offset to the current tissue compartment number of the current tissue compartment to obtain the next tissue compartment number of the next tissue compartment.

3. The data processing apparatus of claim 2, wherein said constant numeral offset is −1 or +1.

4. A data processing apparatus for divers, comprising:

a clock for identifying a dive time;

an inert gas accumulation calculator for calculating at regular intervals an accumulated gas value for a predefined number of tissue compartments;

a computing device for processing all of said tissue compartments within each of said intervals;

wherein said processing of said tissue compartments includes:

creating a hypothetical dive time having an initial dive time determined from said clock, repeatedly adding a specific time offset to said hypothetical dive time;

for each new hypothetical dive time determining, for each tissue compartment in sequence, whether an amount of inert gas hypothetically accumulated within a corresponding tissue compartment after adding the specific time offset exceeds a maximum tolerated inert gas partial pressure for the corresponding tissue compartment, and calculating the corresponding tissue compartment's non-decompression limit if its maximum tolerated inert gas partial pressure is not exceeded;

terminating the current processing of said tissue compartments if during the calculation of a new non-decompression limit a given tissue compartment, it is found that the newly calculated non-decompression limit exceeds the lowest non-decompression limit computed for another tissue compartment.

5. A data processing apparatus for divers comprising:

a computing means for selectively calculating a non-decompression limit for a tissue compartment based on an amount of inert gas accumulated in vivo in conjunction with diving;

means for determining an amount of inert gas in a breathing mix;

wherein said computing means does not calculate the non-decompression limit for said tissue compartment if the amount of inert gas in the breathing mix is less than a maximum tolerated inert gas partial pressure of said tissue compartment.

6. A data processing apparatus for divers comprising:

an inhaled gas computing means for calculating an amount of inhaled inert gas in a breathing mix;

an in vivo gas updating means for regularly updating an amount of inert gas accumulated in viva based on the amount of inhaled inert gas calculated by the inhaled gas computing means; and a non-decompression limit computing means for repeatedly calculating a non-decompression limit for a tissue compartment based on the amount of in vivo inert gas updated by the in viva gas updating means;

wherein the non-decompression limit computing means sets a current non-decompression limit to a previous non-decompression limit when the current non-decompression limit is scheduled to be calculated during a time when the in vivo gas updating means has not updated the amount of in vivo inert gas since the last non-decompression limit calculation and the currently calculated amount of inhaled inert gas is equal to the previously calculated amount of inhaled inert gas.

7. A data processing apparatus for divers comprising:

an inhaled gas computing means for calculating an amount of inhaled inert gas in a breathing mix;

an in vivo gas updating means for regularly updating an amount of inert gas accumulated in viva based on the amount of inhaled inert gas calculated by the inhaled gas computing means; and a non-decompression limit computing means for repeatedly calculating a non-decompression limit for a tissue compartment based on the amount of in vivo inert gas updated by the in viva gas updating means;

wherein when the time to calculate the current non-decompression limit coincides with the time for the in viva gas updating means to update the amount of in vivo inert gas and the currently measured amount of inhaled inert gas is equal to the previously measured amount of inhaled inert gas and the previous non-decompression limit is lower than a predefined maximum non-decompression limit, then the non-decompression limit computing means sets the current non-decompression limit equal to the previous non-decompression limit minus the time elapsed from when the previous non-decompression limit was calculated to when the current non-decompression limit is to be calculated.

8. A data processing apparatus for divers, comprising:

a computing means for calculating a non-decompression limit for a tissue compartment based on an amount of inert gas accumulated in vivo in conjunction with diving;

wherein when an amount of inhaled inert gas contained in a breathing mix is greater than, or equal to, a maximum tolerated inert gas partial pressure for the tissue compartment, the computing means repeatedly adds a specific time interval to a hypothetical dive time initiated to an actual current dive time, calculates a hypothetically accumulated inert gas value according to said hypothetical dive time up until exceeding said maximum tolerated inert gas partial pressure, and then sets the non-decompression limit equal to the hypothetical dive time at which the hypothetically accumulated inert gas value exceeds the maximum tolerated inert gas partial pressure.

9. A data processing method for a data processing apparatus for divers, comprising:

applying a calculation process to each of a plurality of tissue compartments in a cyclic manner, wherein the order of said tissue compartments to which said calculation process is applied is not fixed within each cycle, and wherein said calculation process includes repeatedly calculating a non-decompression limit for each tissue compartment based on an amount of inert gas accumulated within each respective tissue compartment in vivo in conjunction with diving; and determining a tissue compartment computing sequence for each cycle specifying the order of tissue compartments to which said calculating process is applied within each cycle.

10. A data processing method for calculating a non-decompression limit of a plurality of tissue compartments, for use in a data processing apparatus for divers, comprising:

repeatedly adding a specific time offset to a hypothetical dive time initially set to an actual dive time;

for each new hypothetical dive time, determining, for each tissue compartment in sequence, whether an amount of inert gas hypothetically accumulated within a corresponding tissue compartment after adding the specific time offset exceeds a maximum tolerated inert gas partial pressure for the corresponding tissue compartment, and calculating the corresponding tissue compartment's non-decompression limit if its maximum tolerated inert gas partial pressure is not exceeded; and terminating the calculating of the non-decompression limit for a given tissue compartment if during calculation of a new non-decompression limit for the given tissue compartment, it is found that the newly calculated non-decompression limit exceeds the lowest non-decompression limit computed for another tissue compartment.

11. A data processing method for a data processing apparatus for divers, comprising:

determining an amount of inert gas in a breathing mix; and calculating a non-decompression limit for a tissue compartment based on an amount of inert gas accumulated in vivo in conjunction with diving, wherein:

the non-decompression limit for said tissue compartment is not calculated if the amount of inert gas in the breathing mix is less than a maximum tolerated inert gas partial pressure of said tissue compartment.

12. A data processing method for a data processing apparatus for divers, the data processing method comprising:

an inhaled gas computing step for calculating an amount of inhaled inert gas in a breathing mix;

an in vivo gas updating step for regularly updating an amount of inert gas accumulated in vivo based on the amount of inhaled inert gas calculated by the inhaled gas computing step; and a non-decompression limit computing step for repeatedly calculating a non-decompression limit for a tissue compartment based on the amount of in vivo inert gas updated by the in vivo gas updating step;

wherein the non-decompression limit computing step sets a current non-decompression limit to a previous non-decompression limit when the current non-decompression limit is scheduled to be calculated during a time when the in vivo gas updating step has not updated the amount of in vivo inert gas since the last non-decompression limit calculation and the currently measured amount of inhaled inert gas is equal to the previously measured amount of inhaled inert gas.

13. A data processing method for a data processing apparatus for divers, the data processing method comprising:

an inhaled gas computing step for calculating an amount of inhaled inert gas in a breathing mix;

an in vivo gas updating step for regularly updating the amount of inert gas accumulated in vivo based on the amount of inhaled inert gas calculated by the inhaled gas computing step; and a non-decompression limit computing step for repeatedly calculating a non-decompression limit for a tissue compartment based on the amount of in vivo inert gas updated by the in vivo gas updating step;

wherein when the time to calculate the current non-decompression limit coincides with the time for the in vivo gas updating step to update the amount of in vivo inert gas and the currently measured amount of inhaled inert gas is equal to the previously measured amount of inhaled inert gas and the previous non-decompression limit is lower than a predefined maximum non-decompression limit, then the non-decompression limit computing step sets the current non-decompression limit equal to the previous non-decompression limit minus the time elapsed from when the previous non-decompression limit was calculated to when the current non-decompression limit is to be calculated.

14. A data processing method for a data processing apparatus for divers that calculates a non-decompression limit for a tissue compartment based on an amount of inert gas accumulated in vivo in conjunction with diving, wherein:

when an amount of inhaled inert gas contained in a breathing mix is greater than, or equal to, a maximum tolerated inert gas partial pressure for the tissue compartment, a specific time interval is repeatedly added to a hypothetical dive time initiated to an actual current dive time, a hypothetically accumulated inert gas value is calculated according to said hypothetical dive time up until exceeding said maximum tolerated inert gas partial pressure, and then the non-decompression limit is set equal to the hypothetical dive time at which the hypothetically accumulated value inert gas exceeds the maximum tolerated inert gas partial pressure.

15. A computer-readable, data storage medium for recording a computing program as described in claim 14.

16. A computer-readable data storage medium for recording a computing program as described in claim 15.

17. A computing program for achieving in a computer a function for calculating a non-decompression time limit for a plurality of tissue compartments, said computing function including:

stopping the calculation of the non-decompression limit for a given tissue compartment if during calculation the non-decompression limit for the given tissue compartment, it is found that the calculated non-decompression limit exceeds the lowest non-decompression limit computed for another tissue compartment; and when repeatedly adding a specific time interval to a hypothetical dive time that is initially set to a current dive time, making a determination of whether to calculate the non-decompression limit for each tissue compartment based on whether an amount of hypothetical inert gas resulting from addition of the specific time interval exceeds a maximum tolerated inert gas partial pressure in any of said tissue compartments.

18. A computer-readable data storage medium for recording a computing program as described in claim 17.

19. A computing program for achieving in a computer a computing function, including:

calculating an amount of inert gas in a breathing mix;

calculating a non-decompression limit for a tissue compartment based on an amount of inert gas accumulated in vivo in conjunction with diving; and halting the calculating of the non-decompression limit for a given tissue compartment if the amount of inert gas in the breathing mix is less than a maximum tolerated inert gas partial pressure of the tissue compartment.

20. A computing program for achieving in a computer:

an inhaled gas computing function for calculating an amount of inhaled inert gas in a breathing mix;

an in vivo gas updating function for regularly updating an amount of inert gas accumulated in vivo based on the amount of inhaled inert gas calculated by the inhaled gas computing function; and a non-decompression limit computing function for repeatedly calculating a non-decompression limit for each of a plurality of tissue compartments based on the amount of in vivo inert gas updated by the in viva gas updating function;

wherein a current non-decompression limit is set equal to the previous non-decompression limit if the current non-decompression limit is not calculated coincidently with the in viva gas updating function updating the amount of in vivo inert gas, and if the currently measured amount of inhaled inert gas is equal to the previously measured amount of inhaled inert gas.

21. A computing program for achieving in a computer:

an inhaled gas computing function for calculating an amount of inhaled inert gas in a breathing mix;

an in vivo gas updating function for regularly updating an amount of inert gas accumulated in vivo based on the amount of inhaled inert gas calculated by the inhaled gas computing function; and a non-decompression limit computing function for repeatedly calculating a non-decompression limit for each of a plurality of tissue compartments based on the amount of in vivo inert gas updated by the in vivo gas updating function;

wherein a current non-decompression limit is set equal to the previous non-decompression limit minus the time elapsed from calculating the previous non-decompression limit to calculating the current non-decompression limit when the time to calculate the current non-decompression limit is the time for the in vivo gas updating function to update the amount of in vivo inert gas and the currently measured amount of inhaled inert gas is equal to the previously measured amount of inhaled inert gas and the previous non-decompression limit is lower than a predefined maximum non-decompression limit.

22. A program for achieving in a computer a function for calculating a non-decompression limit for a tissue compartment based on an amount of inert gas accumulated in vivo in conjunction with diving, wherein when an amount of inhaled inert gas contained in a breathing mix is greater than or equal to a maximum tolerated inert gas partial pressure for the tissue compartment, a specific time interval value is repeatedly added to a hypothetical diver time that is initially set to a current dive time, and the non-decompression limit is set equal to the hypothetical dive time at the point when the amount of inert gas accumulated as determined from the hypothetical dive time exceeds a maximum tolerated inert gas partial pressure.

23. A data processing apparatus for divers, comprising:

a pressure sensor for determining at regular intervals an amount of inert gas accumulated in each of a predefined number tissue compartments, wherein each tissue compartment is characterized by a gas saturation half-time;

a computing device for processing, in turn, all of said tissue compartments in a cyclic manner, the processing of each tissue component including a computation of its non-decompression limit based on its corresponding amount of accumulated inert gas, said computing device being further effective for storing a reference-tissue-compartment identifying the tissue compartment having the lowest non-decompression limit as each tissue compartment is processed within each cycle;

a tissue compartment selector for selecting the order in which each tissue compartment is processed within each cycle, wherein said tissue compartment selector selects, among the not yet processed tissue compartments within each cycle, the tissue compartment whose saturation half-time is closest to the saturation half-time of said reference-tissue-compartment.

24. A data processing apparatus for divers, comprising:

a computing device for repeatedly calculating, for a predefined group of tissue compartments, a non-decompression limit for each tissue compartment based on a determination of an amount of inert gas accumulated in vivo in said tissue compartments; and a determination device for determining a tissue-compartment-computing-sequence specifying an order sequence according to which said computing device calculates the non-decompression limit of each tissue compartment wherein:

each of said tissue compartments is characterized by a saturation half-time parameter;

said computing device repeatedly cycles through said tissue compartments and sequentially calculates the non-decompression limit of each tissue compartment during each cycle by implementing a separate computing process for each tissue compartment, in sequence, as determined by said tissue-compartment-computing-sequence;

said determination device arranges said tissue compartments within said tissue-compartment-computing-sequence in ascending order based on the absolute value of the difference between the saturation half-time of each tissue compartment during a current cycle and the saturation half-time of the tissue compartment that had the lowest calculated non-decompression limit during the previous cycle as determined by the computing device.

25. A data processing apparatus for divers, comprising:

a computing device for repeatedly calculating, for a predefined group of tissue compartments, a non-decompression limit for each tissue compartment based on a determination of an amount of inert gas accumulated in vivo in said tissue compartments; and a determination device for determining a tissue-compartment-computing-sequence specifying an order sequence according to which said computing device calculates the non-decompression limit of each tissue compartment wherein a tissue-compartment-number is assigned to each tissue compartment in ascending or descending order based on the saturation half-time of each tissue compartment; and the determination device sets the current tissue-compartment-computing-sequence in accordance with said tissue-compartment-numbers by beginning with the tissue compartment having the lowest calculated non-decompression limit as determined by the computing device during a previous computing process and alternately applying a subtracting sequence and an addition sequence to the tissue-compartment-number of a current tissue compartment to obtain the tissue-compartment-number of a next tissue compartment for arrangement in said tissue-compartment-computing-sequence;

wherein said subtracting sequence consists of subtracting a constant numeral offset from the current tissue compartment number of the current tissue compartment to obtain the next tissue compartment number of the next tissue compartment; and wherein said addition sequence consists of adding said constant numeral offset to the current tissue compartment number of the current tissue compartment to obtain the next tissue compartment number of the next tissue compartment.

26. The data processing apparatus of claim 25, wherein said constant numeral offset is −1 or +1.

27. A data processing apparatus for divers comprising:

a computing device for determining an amount of inert eras in a breathing mix and for selectively calculating a non-decompression limit for a tissue compartment based on an amount of inert gas accumulated in vivo in conjunction with diving;

wherein said computing device does not calculate the non-decompression limit for said tissue compartment if the amount of inert gas in the breathing mix is less than a maximum tolerated inert gas partial pressure of said tissue compartment.

28. A data processing apparatus for divers comprising:

an inhaled gas calculator for calculating an amount of inhaled inert gas in a breathing mix;

an in vivo gas updater for regularly updating an amount of inert gas accumulated in vivo based on the amount of inhaled inert gas calculated by the inhaled gas calculator; and a non-decompression limit calculator for repeatedly calculating a non-decompression limit for a tissue compartment based on the amount of in vivo inert gas updated by the in vivo gas updater;

wherein the non-decompression limit calculator sets a current non-decompression limit to a previous non-decompression limit when the current non-decompression limit is scheduled to be calculated during a time when the in vivo gas updater has not updated the amount of in vivo inert gas since the last non-decompression limit calculation and the currently calculated amount of inhaled inert gas is equal to the previously calculated amount of inhaled inert gas.

29. A data processing apparatus for divers comprising:

an inhaled gas calculator for calculating an amount of inhaled inert gas in a breathing mix;

an in vivo gas updater for regularly updating an amount of inert gas accumulated in vivo based on the amount of inhaled inert gas calculated by the inhaled gas calculator; and a non-decompression limit calculator for repeatedly calculating a non-decompression limit for a tissue compartment based on the amount of in vivo inert gas updated by the in vivo gas updater;

wherein when the time to calculate the current non-decompression limit coincides with the time for the in vivo gas updater to update the amount of in vivo inert gas and the currently measured amount of inhaled inert gas is equal to the previously measured amount of inhaled inert gas and the previous non-decompression limit is lower than a predefined maximum non-decompression limit, then the non-decompression limit calculator sets the current non-decompression limit equal to the previous non-decompression limit minus the time elapsed from when the previous non-decompression limit was calculated to when the current non-decompression limit is to be calculated.

30. A data processing apparatus for divers, comprising:

a computing means for calculating a non-decompression limit for a tissue compartment based on an amount of inert gas accumulated in vivo in conjunction with diving;

wherein when an amount of inhaled inert gas contained in a breathing mix is greater than, or equal to, a maximum tolerated inert gas partial pressure for the tissue compartment, the computing means repeatedly adds a specific time interval to a hypothetical dive time initiated to an actual current dive time, calculates a hypothetically accumulated inert gas value according to said hypothetical dive time up until exceeding said maximum tolerated inert gas partial pressure, and then sets the non-decompression limit equal to the hypothetical dive time at which the hypothetically accumulated inert gas value exceeds the maximum tolerated inert gas partial pressure.

* * * * *